United States Patent [19]

Walton et al.

[11] Patent Number: 4,998,453

[45] Date of Patent: Mar. 12, 1991

[54] HYDRAULIC BOLT TENSIONER

[75] Inventors: John N. Walton, Whitley Bay; David Campbell, Ashington, both of England

[73] Assignee: Hedley Purvis Limited, Morpeth, England

[21] Appl. No.: 416,509

[22] Filed: Oct. 3, 1989

[30] Foreign Application Priority Data

Oct. 6, 1988 [GB] United Kingdom ..... 8823474

[51] Int. Cl.[5] ..... B25B 29/02

[52] U.S. Cl. ..... 81/57.38; 254/29 A

[58] Field of Search ..... 81/57.38; 254/29 A

[56] References Cited

U.S. PATENT DOCUMENTS

| | | | |
|---|---|---|---|
| 3,877,326 | 4/1975 | Köck et al. | 81/57.38 |
| 4,438,901 | 3/1984 | Reneau et al. | 81/57.38 |

FOREIGN PATENT DOCUMENTS

| | | |
|---|---|---|
| 2146608 | 9/1971 | Fed. Rep. of Germany . |
| 2807677 | 2/1978 | Fed. Rep. of Germany . |
| 3412689 | 1/1985 | Fed. Rep. of Germany . |
| 2015403 | 2/1979 | United Kingdom . |
| 2143608 | 2/1984 | United Kingdom . |

*Primary Examiner*—Frederick R. Schmidt
*Assistant Examiner*—Lawrence Cruz
*Attorney, Agent, or Firm*—Cushman, Darby & Cushman

[57] ABSTRACT

A hydraulic bolt tensioner for tensioning a threaded bolt extending from a fixed component include a cylinder adapted to react against the component, a piston slidably mounted in the cylinder and having an axial bore therein through which the bolt extends, the piston reacting against a reaction member threaded on the bolt, and a source of hydraulic fluid. Defined within the cylinder are a first chamber the supply of fluid under pressure to which effects powered extension of the piston within the cylinder, and a second chamber the supply of fluid under pressure to which effects powered retraction of the piston within the cylinder.

7 Claims, 2 Drawing Sheets

HYDRAULIC BOLT TENSIONER

BACKGROUND OF THE INVENTION

This invention relates to hydraulic bolt tensioners.

In order to ensure that a nut on a bolt interconnecting two or more components is tightened to a desired degree, it is established practice to utilize a hydraulic bolt tensioner to extend the bolt within its elastic limit and to screw the nut up to the associated abutment surface of the component being tightened while the bolt is so tensioned such that, on release of actuating pressure within the hydraulic piston-cylinder assembly of the tensioner, a secure connection is effected.

Such hydraulic tensioners commonly incorporate a reaction member in the form of a nut or a puller sleeve screwed onto the free end of the bolt, the piston of the hydraulic piston-cylinder assembly reacting between the components to be interconnected and the reaction member to stretch or tension the bolt.

When the tensioning operation has been completed and prior to subsequent use of the tensioner, it is necessary to return the piston of the piston-cylinder assembly from its extended, operative position to its rest position.

It is known to provide hydraulic bolt tensioners incorporating labor saving means for automatically returning the piston to its rest position on release of hydraulic pressure thereon, such means comprising a spring reacting between the cylinder and the piston and constantly urging the piston towards its rest position. Thus, on release of hydraulic pressure on the piston, the spring returns the piston to its rest position and at the same time displaces hydraulic fluid back to a reservoir.

However, with such an arrangement, the time taken for the piston to be returned to its rest position can be substantial, the rate of return depending upon the spring load, the volume of hydraulic fluid to be displaced back to the reservoir, restrictions in the connecting hoses and the like.

In certain situations, such as sub-sea and in nuclear installations, operating time is of prime importance and the slow speed of return of the piston of these known bolt tensioners can create problems.

SUMMARY OF THE INVENTION

It is an object of the invention to provide a hydraulic bolt tensioner incorporating means whereby the piston thereof can be returned from its extended position to its rest position more quickly than heretofore.

According to the present invention there is provided a hydraulic bolt tensioner comprising a cylinder adapted to react against a fixed component from which extends a threaded bolt, a piston slidably mounted in the cylinder and having an axial bore therein through which, in use, said bolt extends, the piston being adapted to react against a reaction member threaded on the bolt, and a source of hydraulic fluid under pressure for effecting powered movement of the piston within the cylinder the piston-cylinder assembly defining therein a first chamber the supply of fluid to which effects powered extension of the piston within the cylinder, and a second chamber the supply of fluid to which effects powered retraction of the piston within the cylinder.

It will thus be appreciated that such an arrangement enables controlled powered retraction of the piston whereby the piston can, on appropriate control of the source of hydraulic fluid, be returned extremely quickly from its extended position to its normal est or retracted position in preparation for subsequent use of the tool.

Preferably the piston includes an increased-diameter outer end portion adapted to react against said reaction member and an increased diameter inner end portion, the cylinder including a reduced-diameter intermediate extent, the first chamber being defined between the outer end portion of the piston and the intermediate extent of the cylinder and the second chamber being defined between the inner end portion of the piston and the intermediate extent of the cylinder.

Conveniently hydraulic fluid from the source is fed to the first and second chambers through respective bores formed in the reduced diameter intermediate extent of the cylinder.

In a preferred embodiment of the invention, the hydraulic bolt tensioner includes a piston overstroke eliminator valve which, once the piston has reached its maximum extension, is actuated to relieve fluid pressure within the first chamber and prevent further extension of the piston.

Conveniently the overstroke eliminator valve is mounted in the intermediate extent of the cylinder and is actuated by the inner end portion of the piston whereby fluid under pressure supplied to the first chamber is fed through the valve into the second chamber and back to a reservoir associated with the source.

Preferably the overstroke eliminator valve further comprises a pressure relief valve, the arrangement being such that, on retraction of the piston and when the fluid pressure within the second chamber exceeds a predetermined maximum value, the valve is actuated to relieve fluid pressure within the second chamber.

In such an embodiment, and on actuation of the pressure relief valve, fluid under pressure supplied to the second chamber may be fed through the valve into the first chamber and back to the reservoir associated with the source.

DESCRIPTION OF THE PREFERRED EMBODIMENTS

Figure 1:
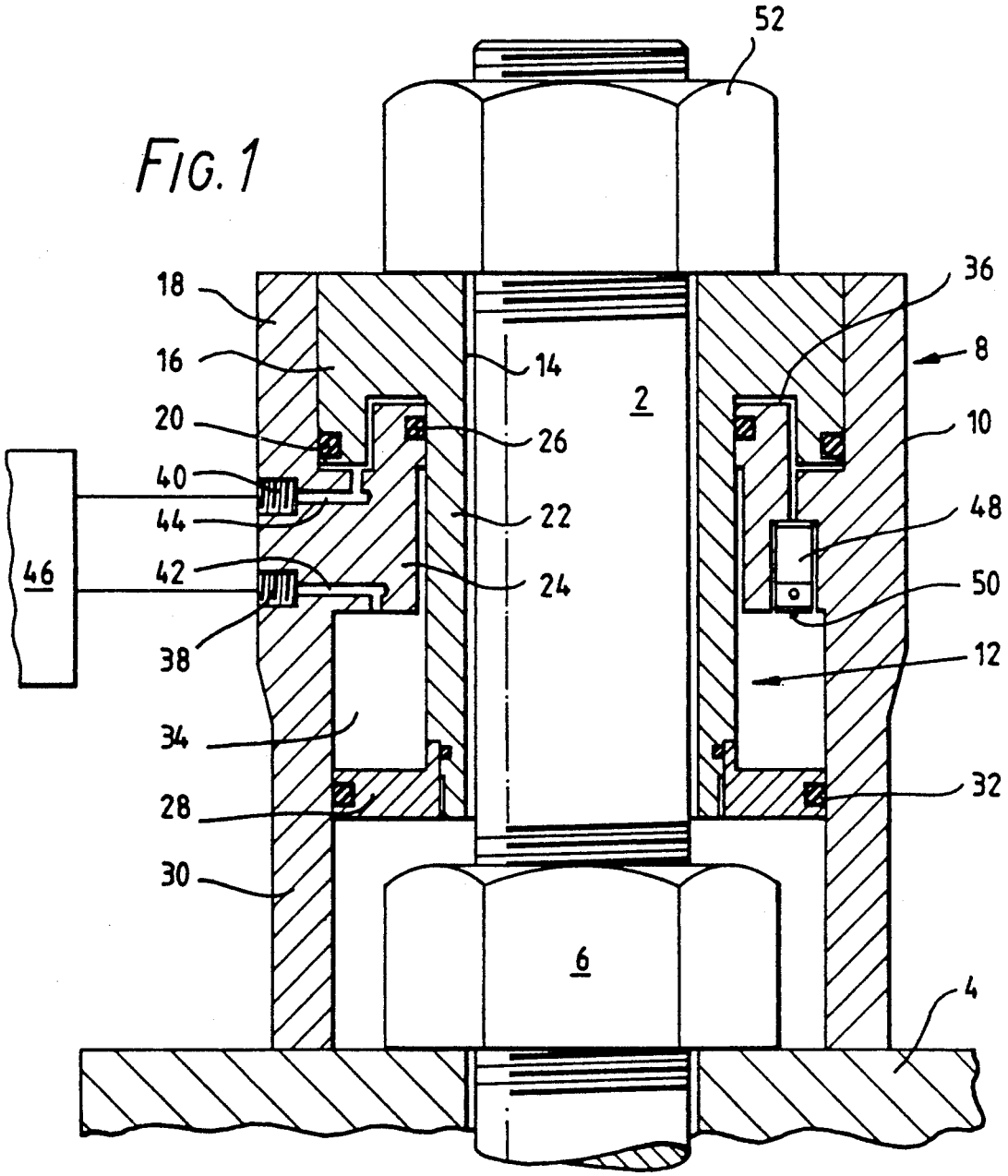
FIGS. 1 and 2 are vertical sections through two alternative hydraulic bolt tensioners according to the invention.

Referring to FIG. 1 there is shown a threaded bolt 2 extending from components to be secured together one of which is shown at 4, a nut for effecting the securing together being referenced 6.

A hydraulic tensioner for tensioning the bolt 2 while tightening the nut 6 thereon is indicated generally at 8. The tensioner comprises a cylinder 10 in which is slidably mounted a piston indicated generally at 12 and having an axial bore 14 formed centrally therethrough.

More particularly, the piston 12 includes an upper end portion 16 adapted to slide in an upper end extent 18 of the cylinder 10, a sealing ring 20 maintaining a hydraulic seal between the components 16, 18, an intermediate portion 22 slidably mounted in a reduced-diameter intermediate extent 24 of the cylinder 10, a sealing ring 26 maintaining a hydraulic seal between the components 22, 24, and a lower end portion 28 slidable in a lower end extent 30 of the cylinder 10, a sealing ring 32 maintaining a hydraulic seal between the components 28, 30.

Thus there are located within the cylinder 10 a lower chamber 34 defined between the lower end portion 28 of the piston 12 and the intermediate extent 24 of the cylinder 10 and an upper chamber 36 defined between the upper end portion 16 of the piston 12 and the intermediate extent 24 of the cylinder 10, these chambers 34, 36 being sealed from one another.

A pair of ports 38, 40 are formed in the intermediate extent 24 of the cylinder 10, bores 42, 44 feeding from said ports into the chambers 34, 36 respectively. A source 46 of hydraulic fluid under pressure is connected to the ports 38, 40 as will be described in more detail below.

An overstroke eliminator/pressure relief valve 48 is mounted in the intermediate extent 24 of the cylinder 10, the chambers 34, 36 being interconnected with one another through this valve 48. The valve 48 has a normal closed position shown in the drawing, an operating plunger 50 of the valve projecting just below the lower surface of the intermediate extent 24 of the cylinder 10 for reasons which will become apparent.

In use, the described tensioner is positioned over the bolt 2 with the lower end of the cylinder 10 seating on the component 4 and with the piston 12 in its retracted position shown in the drawing and surrounding the bolt 2.

A reaction nut 32 is screwed onto the free end of the bolt 2 to engage the upper end portion 16 of the piston 12. Hydraulic fluid under pressure, typically up to 21750 psi, is fed by the source 46 at a very low delivery rate to port 40, through bore 44 and into chamber 36 whereby the piston 12 rises in the cylinder 10 and applies tension to the bolt 2 by way of the reaction nut 52. The nut 6 is tightened in conventional manner while tension is applied to the bolt 2.

As the piston 12, rises, hydraulic fluid in he chamber 34 is displaced through bore 42 and port 38 back to the reservoir associated with the source 46.

If the piston 12 reaches its maximum stroke, determined by abutment of the lower portion 28 thereof with the lower surface of the intermediate extent 24 of the cylinder 10, the plunger 50 of the valve 48 is displace by the portion 28 of the piston 12 to open the valve 48 and interconnect chambers 34 and 36. Fluid under pressure supplied to chamber 36 thus bleeds through the valve 48 into the chamber 34 and back to the reservoir whereby pressure in the chamber 36 is lost and overstroke of the piston 12 is prevented.

On completion of the tensioning operation, the piston 12 must be returned to its retracted position and, in order to achieve this condition of the tensioner, hydraulic fluid at relatively low pressure, typically 1000 psi, is fed from the source 46 at a high delivery rate to port 38 and hence to chamber 34 whereby piston 12 descends quickly to its fully retracted position The valve 48 is spring-loaded to resist this relatively low pressure in the chamber 34, while, during retraction of the piston 12, fluid in the chamber 36 is displaced by the upper end portion 16 of the piston 12 through the bore 44 and port 40 back to the reservoir.

When the piston 12 is fully retracted and fluid is still being pumped to the chamber 34, pressure in said chamber 34 increases until the valve 48 opens. Then, any fluid still being supplied to the chamber 34 is fed through the valve 48 into the chamber 36 and back to the reservoir, thus preventing excessive pressure build-up within the chamber 34.

The provision of powered return of the piston 12, in particular by way of fluid supplied at a high delivery rate, enables retraction of the piston 12 to be effected extremely quickly, which is of great value in sub-sea and nuclear situations and where a series of nuts are to be tightened in sequence.

Figure 2:
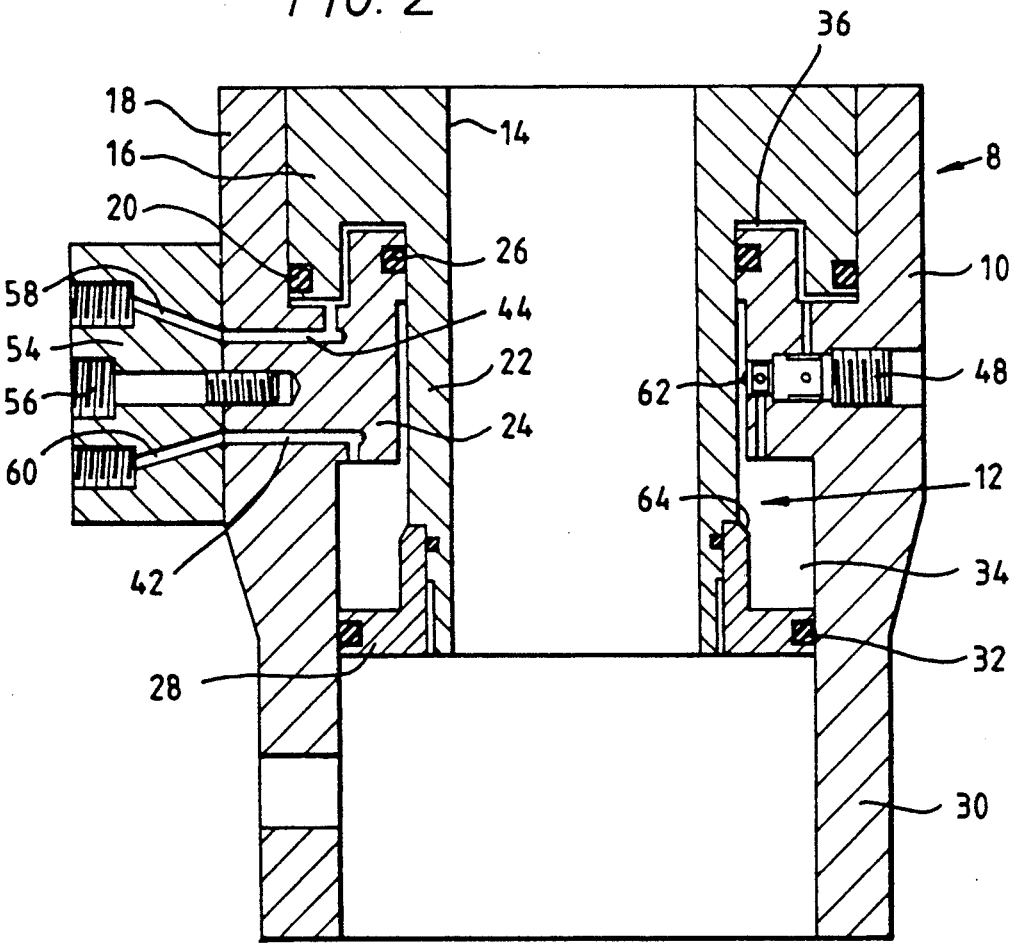

FIG. 2 shows an alternative embodiment of the invention in which parts equivalent to those of the embodiment of FIG. 1 are similarly referenced.

The function and operation of this tool are the same as that of the tool of FIG. 1, but it embodies a modified inlet manifold for the supply of hydraulic fluid to the chambers 34 and 36 and a modified overstroke eliminator/pressure relief valve 48.

More particularly, the tensioner 8 is provided with a manifold block 54 which locates in a keyway formed in the cylinder 10, a single screw 56 securing the block 54 to the cylinder 10.

The manifold block 54 is provided with upper and lower pairs of bores 58, 60 which communicate with the bores 44 and 42 respectively formed in the cylinder 10. The provision of bores each communicating with an associated one of the chambers 34, 36 facilitates the connection of a plurality of tools to a single hydraulic source as is often a requirement in sub-sea operations.

On smaller diameter tensioners, as illustrated in FIG. 2, space is somewhat limited and it can prove difficult to incorporate an overstroke eliminator/pressure relief valve in the manner shown in FIG. 1. The valve 48 of the tool of FIG. 2 is disposed horizontally instead of vertically and includes a steel ball 62 projecting from the end of the valve and depressed by a tapered surface 64 on lower end portion 28 of the piston 12 when said piston reaches its position of maximum stroke. Such an arrangement enables the lower regions of the tool to be much smaller in diameter and eliminates the need for the lower regions of the tool, in particular the lower extent 30 of the cylinder 10, to taper inwardly.

The precise construction of tensioners according to the invention can differ from those illustrated. The lower extent of the cylinder 10 may or may not be integral with the remainder of the cylinder, while the lower end extent 28 of the piston may or may not be integral with the remainder of the piston.

The conventional reaction nut 52 may be replaced by a puller sleeve or by a tapered nut co-operating with a correspondingly-tapered recess in the upper surface of the piston 12.

The nut 6 may be rotatable on the bolt 2 by any suitable means, for example either directly by a tommy bar located in a hole drilled in each flat of the nut or by an adaptor fitted over the nut and rotated by a tommy bar located in holes in the adaptor.

Instead of relieving excess pressure in the chamber 34 by way of the valve 48, the source 46 supplying hydraulic fluid to the tensioner may incorporate a limit switch so arranged that, once the pressure in the chamber 34 reaches a predetermined maximum value, the source is switched off thus discontinuing the supply of fluid to the chamber 34. In such an embodiment, the valve 48 acts only as an overstroke eliminator.

What we claim is:

1. A hydraulic bolt tensioner for tensioning a threaded bolt extending rom a fixed component, the bolt carrying a threaded reaction member thereon, the tensioner comprising:

a cylinder adapted to react against the fixed component, a piston slidably mounted in the cylinder and defining therein an axial bore through which, is use, said bolt extends, the piston being adapted to react against said reaction member, the configurations of the piston and the cylinder being such as to define within the cylinder first and second chambers, and a source of hydraulic fluid under pressure connected to both the first and the second chambers for effecting powered movement of the piston within the cylinder, the arrangement being such that on supply of fluid under pressure from the source to the first chamber, powered extension of the piston within the cylinder is effected, and on supply of fluid under pressure from the source to the second chamber, powered retraction of the piston within the cylinder is effected.

2. A hydraulic bolt tensioner as claimed in claim 1 in which the piston includes an increased-diameter outer end portion adapted to react against said reaction member, and an increased-diameter inner end portion, the cylinder including a reduced-diameter intermediate extent, the first chamber being defined between the outer end portion of the piston and the intermediate extent of the cylinder and the second chamber being defined between the inner end portion of the piston and the intermediate extent of the cylinder.

3. A hydraulic bolt tensioner as claimed in claim 2 in which the reduced-diameter intermediate extent of the cylinder defines therein bores feeding into the first and second chambers respectively, hydraulic fluid from the source being fed to said firs and second chambers through said respective bores.

4. A hydraulic bolt tensioner as claimed in claim 3 and including a piston overstroke eliminator valve which, once the piston has reached its maximum extension, is actuated to relieve fluid pressure within the first chamber and prevent further extension of the piston.

5. A hydraulic bolt tensioner as claimed in claim 4 in which the hydraulic source has a reservoir associated therewith, the overstroke eliminator valve being mounted in the intermediate extent of the cylinder and being actuated by the inner end portion of the piston whereby fluid under pressure supplied to the first chamber is fed through the valve into the second chamber and back to said reservoir.

6. A hydraulic bolt tensioner as claimed in claim 5 in which the overstroke eliminator valve further comprises a pressure relief valve, the arrangement being such that, on retraction of the piston and when the fluid pressure within the second chamber exceeds a predetermined maximum value, the valve is actuated to relieve fluid pressure within the second chamber.

7. A hydraulic bolt tensioner as claimed in claim 6 in which, on actuation of the pressure relief valve, fluid under pressure supplied to the second chamber is fed through the valve into the first chamber and back to the reservoir associated with the source.

* * * * *